United States Patent [19]

Jonsson

[11] Patent Number: 4,793,106

[45] Date of Patent: Dec. 27, 1988

[54] WINDOW COMPRISING A FRAME WITH A GROOVE FOR AN INTERNAL PANEL MEMBER

[75] Inventor: Gorm L. Jonsson, Haugesund, Norway

[73] Assignee: V. Kann Rasmussen Industri A/S, Soborg, Denmark

[21] Appl. No.: 923,098

[22] Filed: Oct. 24, 1986

[30] Foreign Application Priority Data

Oct. 30, 1985 [DK] Denmark ..... 4983/85

[51] Int. Cl.[4] ..... E06B 1/04

[52] U.S. Cl. ..... 52/204; 52/214; 52/773; 52/775

[58] Field of Search ..... 52/210, 214, 401, 402, 52/773, 775, 204, 72, 200, 584

[56] References Cited

U.S. PATENT DOCUMENTS

| | | | |
|---|---|---|---|
| 1,888,535 | 11/1932 | Kreüger et al. | 52/584 X |
| 2,124,353 | 7/1938 | Plym | 52/401 |
| 2,505,553 | 4/1950 | Krantz | 52/773 |
| 2,638,191 | 5/1953 | Menosky | 52/773 |
| 2,646,863 | 7/1953 | Hinz et al. | 52/773 |
| 2,693,156 | 11/1954 | Wasserman | 52/200 |
| 2,795,306 | 6/1957 | Fey et al. | 52/773 |
| 3,034,260 | 5/1962 | Wasserman | 52/200 |
| 3,137,901 | 1/1964 | Malachowski | 52/773 |
| 3,423,897 | 1/1969 | Birum, Jr. | 52/773 |
| 3,487,601 | 1/1970 | James | 52/400 |
| 3,673,945 | 7/1972 | Rachlin et al. | 52/765 |
| 3,999,356 | 12/1976 | Packman | 52/765 |
| 4,283,891 | 8/1981 | Moeller | 52/144 |
| 4,527,369 | 7/1985 | Adams | 52/211 |
| 4,553,360 | 11/1985 | Colombo | 52/202 |
| 4,555,884 | 12/1985 | van Eerden | 52/397 |
| 4,570,393 | 2/1986 | Minter | 52/72 |
| 4,594,821 | 6/1986 | Bechtold | 52/72 |

FOREIGN PATENT DOCUMENTS

| | | | |
|---|---|---|---|
| 123948 | 1/1973 | Denmark . | |
| 440650 | 12/1967 | Switzerland . | |
| 1003542 | 9/1965 | United Kingdom | 52/773 |

*Primary Examiner*—John E. Murtagh
*Assistant Examiner*—Andrew Joseph Rudy
*Attorney, Agent, or Firm*—Lane & Aitken

[57] ABSTRACT

A window main frame, particularly for installation in an inclined roof, is provided with a groove extending into the internal edge surface and adapted to receive the edge of an internal panel member and having a width that is substantially larger than the thickness of the panel member. The panel member abuts against the lateral wall closest to the frame opening and a slit is left between the panel member and the other lateral wall of the groove. The panel member is fixed in the groove by means of spring clamps resting against one lateral wall of the groove, and by a resilient tongue directed towards the other lateral wall of the slit the panel member is pressed against the lateral wall, thereby preventing the panel member from being pulled out of the groove.

9 Claims, 3 Drawing Sheets

WINDOW COMPRISING A FRAME WITH A GROOVE FOR AN INTERNAL PANEL MEMBER

A window comprising a frame with a groove for an internal panel member.

BACKGROUND OF THE INVENTION

In windows for living rooms the edge surfaces of the brickwork or roof opening are frequently covered with a so-called internal panel member which after the window has been installed is secured to the inward facing edge surface of the main frame, said edge surface being provided, for that purpose, with a groove adapted to receive the edge of the panel. When the width of the groove closely corresponds to the thickness of the panel, securing may be effected by gluing, but a mechanical connection is often preferred—as an alternative or as a supplement—e.g. by means of tightening wedges or screwed ono angle hinges necessitating a tool to be inserted into the generally narrow space between the panel and the edge surfaces of the wall or roof opening. However, the space is frequently so narrow that it is extremely difficult or even impossible to effect such a mechanical securing which shall possibly only serve to keep the panel member in place until the glue has hardened.

SUMMARY OF THE INVENTION

The object of this invention is to provide a main frame structure in which a mechanical securing of the internal panel member may be effected so to say automatically, i.e. without the use of tools when mounting the panel in said groove.

More particularly, the invention relates to a window comprising a groove extending into the inward facing edge portion of the main frame and adapted to receive the edge of an internal panel member abutting against the lateral wall in the groove closest to the main frame opening, and according to the invention such a window differs from the prior art structures of the same type in that the width of the groove is substantially larger than the thickness of the internal panel member so that a slit is left between the panel member and the other lateral wall of the groove, spring clamps serving to press the panel against the first mentioned lateral wall of the groove being provided in said slit, said spring clamps having a body secured relative to the one side of the slit and a spring tongue the free end of which engages the other side of the slit, said spring tongue having such a direction that it allows the panel edge to be pushed into the groove, but secures the panel against pulling-out by virtue of said engagement.

Such spring clamps may be produced at low costs, and neither needs their mounting on the frame portion or on the internal panel member imply any noticeable increase in the costs of production. An adequate number of spring clamps may for instance be delivered as separate parts together with the main frame or the panel member that may be prepared for the mounting of the spring clamps in connection with the installation of the main frame or along with finishing the window section by mounting the internal panel member. Upon pushing or pressing the edge portion of said panel member into the groove the spring tongues will act as a kind of barb which will not resist insertion of the panel member, but in case of a backward movement will grip into the material against which the free end of the spring tongue is pressed, thereby keeping the panel member in place.

When positioning the panel member the spring force is established by pressing the spring tongue towards the fixed body and, consequently, no precise fixation of the spring clamps in the groove is prescribed. The engagement of the free end of the spring tongue with the material is effected when the panel is subjected to a force in the pulling-out direction.

The latitude of fixation is particularly utilized when the window main frame is adapted to be installed in an inclined roof and is produced as an integral unit, preferably from a plastic, together with a flashing flange and is reinforced by a stiffening rail at least along the main frame sides extending in the height direction of the roof, the mounting of the spring tongues being then simplified in that the stiffening rail is a metallic profile constituting the lateral wall of the groove remote from the main frame opening and having a flange serving as groove bottom, and in that each spring clamp engages with a bent foot at the free end of the body beneath a stirrup in the flange of the stiffening rail, said stirrup being formed by punching and stamping. In this case the mounting of the spring clamps may be effected by hooking them beneath the stirrups by means of the foot and solely thereby keeping them in place when the necessary security until they get firmly clamped upon insertion of the panel member in the groove.

Various embodiments of windows provided with 20 spring clamps for fixing an internal panel member according to the invention will be explained in the following with reference to the drawings, in which

DETAILED DESCRIPTION OF THE PREFERRED EMBODIMENTS

Figure 1:
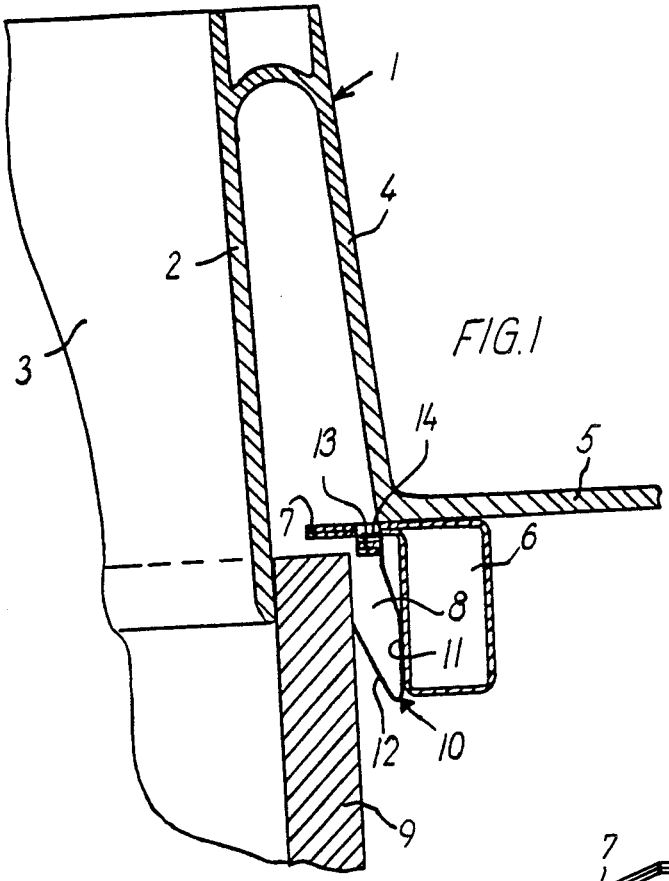
FIG. 1 is a cross-sectional view of a main frame portion with a panel member in place and extending in the direction of the roof inclination.
Figure 2:
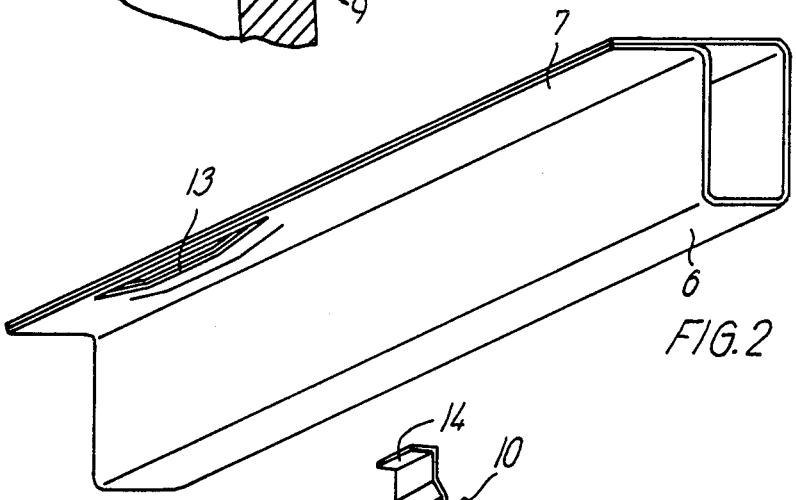
FIGS. 2 and 3 are separate perspective views of a piece of stiffening rail and an angular spring clamp, respectively.
Figure 3:
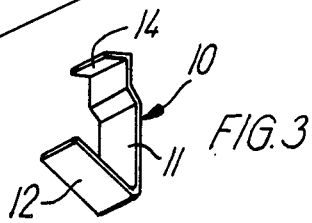

The main frame 1 illustrated in FIG. 1 is supposed to be produced from an appropriate plastics material and comprises an internal wall 2 defining the main frame opening 3 and an external wall 4 extending in an outwardly directed flashing flange 5 adapted to be sealingly mounted on the covering of a roof, not illustrated. On its underside the flange 5 is provided with a reinforced stiffening rail 6, see also FIG. 2, which in the illustrated embodiment consists of non-corroding sheet metal bent to box-shape with a laterally protruding flange 7 forming the bottom of the groove 8 formed between the internal surface of the main frame 2 and the rail 6 and serving to receive the edge of an internal panel member 9. The main frame 1 has an inwardly facing edge portion facing the room in which the window is located, the inwardly facing edge portion being defined in the embodiments illustrated in FIGS. 1 and 4 by the inward ends of the internal wall 2 and the reinforcing stiffening rail 6, the groove 8 being formed in this edge portion. The thickness of said panel member is somewhat smaller than the width of the groove and two or more angularly bent spring clamps 10 are inserted between the panel and the stiffening rail, see also FIG. 3, said spring clamps having a body 11 to engage the rail 6 and a tongue 12 sloping inwardly into the groove 8, the free end edge of said tongue in the unloaded condition of the spring clamp being positioned at a distance from the plane of the internal wall 2 of the main frame that is smaller than the thickness of the panel 9.

Stirrups 13 which together with the flange proper forms a slit to receive a foot 14 on the spring clamp 10 are provided in the flange 7 of the stiffening rail by punching and stamping. As it will appear, said foot is integral with a cranked portion of the body 11 so that the spring clamp may be easily positioned in place, thereby forcing the foot 14 to engage beneath the stirrup 13.

In many cases it is preferred to fasten spring clamps on the internal panel member 9, this being easily effected prior to pressing the panel into the groove 8. FIGS. 4 and 5 and FIGS. 6 and 7 illustrate two embodiments of spring clamps 15 and 16. Said clamps may for instance be secured to the panel 9 by means of nails 18 driven into the panel through holes 19 in the spring clamps. It is thus obtained that after any demounting of the panel 9 for inspection or repair of the roof structure, the clamps may be moved to and mounted at new places of the panel, thereby ensuring effective securing when repressing the panel into the groove.

Figure 4:
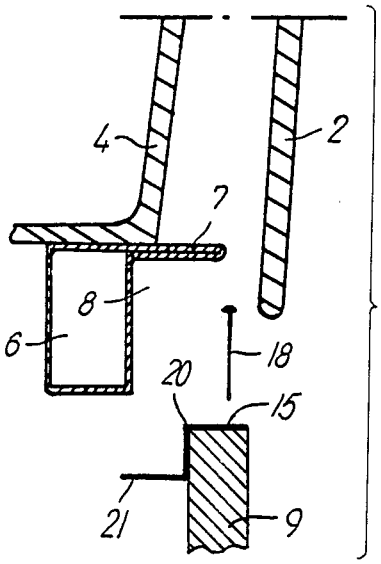
FIG. 4 is a cross-sectional view of a main frame portion and a second embodiment of a spring clamp.
Figure 5:
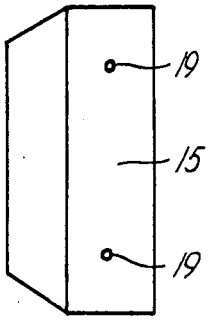
FIG. 5 is a view from above of the spring clamp in FIG. 4.

In FIGS. 4 and 5 the spring clamp 15 is applied to a window main frame 1 corresponding to that illustrated in FIG. 1. The spring clamp 15 has a body 20 bent to a substantially right angle in order to allow easy mounting on and a good abutment against the top edge of the panel 9, and a spring tongue 21 outward directed in the groove 8.

Figure 6:
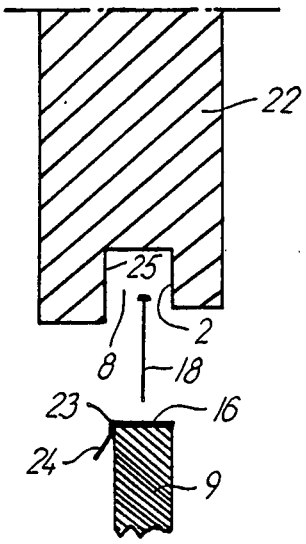
FIG. 6 is a cross-sectional view of a wood main frame portion with the internal panel member and a third embodiment of a spring clamp.
Figure 7:
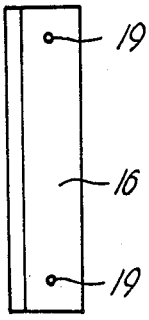
FIG. 7 is a view from above of the spring clamp in FIG. 6.

In FIGS. 6 and 7 the spring clamp 16 is applied to a window main frame 22 made of wood and comprising a groove 8 in the downward facing edge portion which is defined by the inward end of the main frame 22. As above, the spring clamp 16 has a substantially rightangled body 23 and a spring tongue 24 directed outwardly into the groove in an inclined direction in order to solidly engage the wood of the external lateral wall 25 of the groove.

Figure 8:
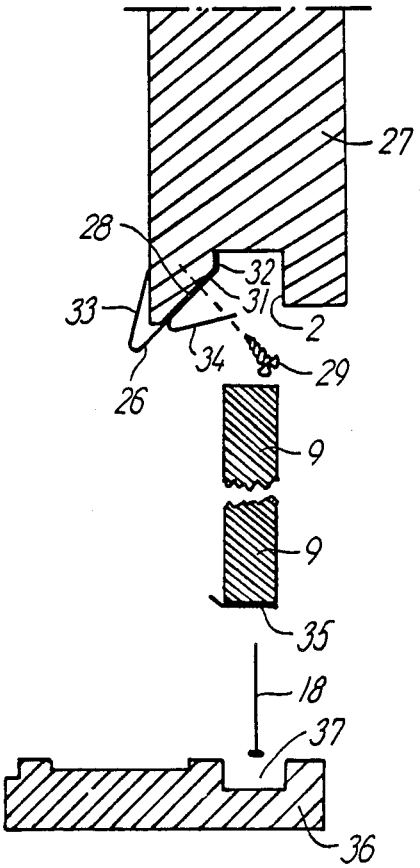
FIG. 8 is a cross-sectional view of a wood main frame portion with the internal panel member and a fourth embodiment of a spring clamp and of an internal covering or decorative moulding.
Figure 9:
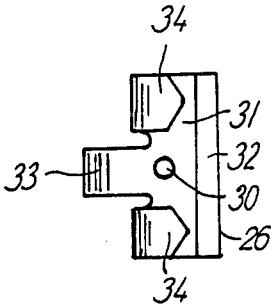
FIG. 9 is an oblique lateral view of the spring clamp on the main frame in FIG. 8.

FIGS. 8 and 9 illustrate a fourth embodiment of the spring clamp 26 adapted to be secured on an obliquely bevelled external side wall 28 in a groove 8 of a window main frame 27 made of wood, which is the groove 8 being formed in an inwardly facing edge portion defined by the inward end of the main frame 27. After the window has been mounted in the roof structure the oblique bevelling of the side wall 28 allows the spring clamp 26 to be easily secured by screwing a screw 29 through a hole 30 in the clamp and into the main frame. The body 31 of the spring clamp is provided with a folded end portion 32 and a clamping tongue 33 in such a manner that the clamp after being pressed onto the bevelled side wall 28 is self-retaining while the screw 29 is being driven in and, therefore, the mounting of the clamp is very simple. Two spring tongues on each clamp extending inwards into the groove offers an effective securing of the panel 9.

Moreover, FIG. 8 illustrates a decorative covering 36 to be mounted at the lower or internal edge of the panel member 9. After having been mounted the covering 36 is retained by a spring clamp 35. The decorative covering is provided with a groove 37 of larger width than the thickness of the panel and the spring clamp 35 is, as described above, secured to the panel at its lower edge and formed so that the decorative covering after the groove 37 has been pressed around the lower edge of the panel is secured by the spring clamp.

I claim:

1. A window comprising a main frame comprising lateral and transversal members, a main opening and an edge portion facing in a direction transverse to a plane containing the main frame:

a groove extending into the edge portion in a direction transverse to the plane containing the main frame, said groove being defined by a first lateral wall adjacent to the main opening of said main frame and by a second lateral wall-opposite to said first lateral wall;

an internal panel member abutting against said first lateral wall and having a thickness in a direction perpendicular to said first lateral wall, said groove having a width substantially larger than the thickness of the internal panel member, so that a slit is left between the panel member and a surface of said second lateral wall;

spring clamps in said slit for pressing the panel member against said first lateral wall of said groove, each spring clamp including a body secured to the panel member and a spring tongue extending in a direction allowing the panel member to be inserted into the groove but opposing the separation of the panel member from the groove, the spring tongue having a free end biting into the second lateral wall of the groove when the panel member is subjected to a pulling-out force.

2. A window according to claim 1, wherein said second lateral wall of the groove, at least along said lateral members, comprises a stiffening rail for reinforcement of the window, said stiffening rail being a metallic profile and having a flange defining a bottom for said groove;

said flange has at least one stirrup; and the body of each of said spring clips has a free end received in said stirrup.

3. A window according to claim 2, wherein said free end of the body of each said spring clip includes a foot bent at an angle relative to the rest of the body, said foot being received in said stirrup.

4. A window according to claim 2, wherein a flashing flange is integral with said second lateral wall.

5. A window according to claim 1, wherein said groove includes a bottom, and the spring tongue extends from said body to said free end in a direction having a component away from the bottom of the groove.

6. A window comprising a main frame comprising lateral and transversal members, a main opening and an edge portion facing in a direction transverse to a plane containing the main frame;

a groove extending into the edge portion in a direction transverse to the plane containing the main frame, said groove being defined by a first lateral wall adjacent to the main opening of said main frame and by a second lateral wall opposite to said first lateral wall;

an internal panel member abutting against said first lateral wall and having a thickness in a direction perpendicular to said first lateral wall, said groove having a width substantially larger than the thickness of the internal panel member, so that a slit is left between the panel member and a surface of said second lateral wall;

spring clamps in said slit for pressing the panel member against said first lateral wall of said groove, each spring clamp including a body secured to the second lateral wall of the groove and a spring tongue extending in a direction allowing the panel member to be inserted into the groove but opposing the separation of the panel member from the groove, the spring tongue having a free end biting into the panel member when the panel member is subjected to a pulling-out force.

7. A window according to claim 6, wherein said groove includes a bottom, and the spring tongue extends from said body to said free end in a direction having a component toward the bottom of the groove.

8. A window according to claim 6, wherein said second lateral wall of the groove, at least along said lateral members, comprises a stiffening rail for reinforcement of the window, said stiffening rail being a metallic profile and having a flange defining a bottom for said groove.

9. A window according to claim 8, wherein a flashing flange is integral with said second lateral wall.

* * * * *